US009566803B2

(12) United States Patent
Denda

(10) Patent No.: US 9,566,803 B2
(45) Date of Patent: Feb. 14, 2017

(54) RECORDING METHOD AND PRINTER

(71) Applicant: Seiko Epson Corporation, Tokyo (JP)

(72) Inventor: Atsushi Denda, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/741,931

(22) Filed: Jun. 17, 2015

(65) Prior Publication Data

US 2015/0367656 A1 Dec. 24, 2015

(30) Foreign Application Priority Data

Jun. 18, 2014 (JP) ..... 2014-125108

(51) Int. Cl.

| | |
|---|---|
| ***B41J 11/00*** | (2006.01) |
| ***B41J 2/01*** | (2006.01) |
| ***B41M 5/00*** | (2006.01) |
| ***B41J 2/21*** | (2006.01) |
| ***B41M 7/00*** | (2006.01) |

(52) U.S. Cl.

CPC ..... *B41J 11/0015* (2013.01); *B41J 2/01* (2013.01); *B41J 2/2114* (2013.01); *B41M 5/0011* (2013.01); *B41M 5/0023* (2013.01); *B41M 7/0036* (2013.01)

(58) Field of Classification Search

CPC ..... B41J 2/01; B41J 2/2114; B41J 11/021; B41J 5/0011; B41J 5/0023; B41J 11/0015; B41M 7/0036

USPC ..... 347/21

See application file for complete search history.

(56) References Cited

U.S. PATENT DOCUMENTS

| | | | | |
|---|---|---|---|---|
| 2007/0206039 | A1 | 9/2007 | Kawamura et al. | |
| 2008/0145628 | A1* | 6/2008 | Oyanagi | B22F 9/04 428/206 |
| 2008/0225100 | A1* | 9/2008 | Kumagai | B41J 2/15 347/102 |
| 2008/0250970 | A1 | 10/2008 | Oyanagi et al. | |
| 2008/0259100 | A1* | 10/2008 | Rengaswamy | C09D 11/30 347/1 |
| 2009/0220695 | A1* | 9/2009 | Oyanagi | B41J 2/2114 427/256 |

(Continued)

FOREIGN PATENT DOCUMENTS

| | | |
|---|---|---|
| EP | 2143769 A1 | 1/2010 |
| EP | 2594617 A2 | 5/2013 |

(Continued)

OTHER PUBLICATIONS

Partial European Search Report for Patent Application No. EP15172768.2 dated Sep. 29, 2015 (5 pages).

(Continued)

*Primary Examiner* — Stephen Meier
*Assistant Examiner* — Alexander D Shenderov
(74) *Attorney, Agent, or Firm* — Harness, Dickey & Pierce, P.L.C.

(57) ABSTRACT

There is provided a recording method, in which a glitter pigment ink and a clear ink containing substantially no color material is used with respect to a coated paper or a film, including: at least one of (A) primarily-applying the clear ink before applying the glitter pigment ink and (B) applying the clear ink in the same scanning at the time of applying the glitter pigment ink; and (C) secondarily-applying the clear ink after applying the glitter pigment ink.

8 Claims, 2 Drawing Sheets

(56) References Cited

U.S. PATENT DOCUMENTS

| | | | | |
|---|---|---|---|---|
| 2010/0009136 | A1 | 1/2010 | Oyanagi et al. | |
| 2012/0040147 | A1 | 2/2012 | Komatsu et al. | |
| 2012/0249668 | A1 | 10/2012 | Denda et al. | |
| 2013/0057616 | A1 | 3/2013 | Hirata et al. | |
| 2013/0083118 | A1* | 4/2013 | Ohashi ..... | B41M 5/00 347/20 |
| 2013/0108841 | A1 | 5/2013 | Denda et al. | |

FOREIGN PATENT DOCUMENTS

| | | | |
|---|---|---|---|
| JP | 2005-532924 | A | 11/2005 |
| JP | 2008-174712 | A | 7/2008 |
| JP | 2008-213151 | A | 9/2008 |
| JP | 2010-018651 | A | 1/2010 |
| JP | 2011-137164 | A | 7/2011 |
| JP | 2012-206481 | A | 10/2012 |
| JP | 2013-052654 | A | 3/2013 |
| JP | 2013-091761 | A | 5/2013 |
| JP | 2013-193338 | A | 9/2013 |
| WO | WO-03-045698 | A1 | 6/2003 |
| WO | WO-2007-033031 | A2 | 3/2007 |

OTHER PUBLICATIONS

Extended European Search Report for Application No. EP 15172768.2 dated Jan. 14, 2016 (9 pages).

* cited by examiner

RECORDING METHOD AND PRINTER

BACKGROUND

1. Technical Field

The present invention relates to a recording method and a printer used in the recording method.

2. Related Art

In the related art, various methods for recording an image on a recording medium have been known. For example, in an ink jet recording method, an image is recorded on a recording medium by microscopic ink droplets ejected from nozzles of a head for ink jet recording.

The image recorded on the recording medium, from the viewpoint of sharpness and clarity, is required to have good glossiness. For example, it is disclosed in JP-T-2005-532924 that, when ink containing colorant and ink containing no colorant are used, and ink containing no colorant is printed only at the position at which ink containing colorant is not present on a recording medium, an image having uniform glossiness can be recorded on the recording medium.

In recent years, an image having glitter caused by the gloss of metal or the like has attracted attention because it has unique design properties, among such properties as glossiness. For example, it is disclosed in JP-A-2008-174712 and JP-A-2011-137164 that a glitter image is formed using a glitter ink containing a glitter pigment (for example, gold powder or silver powder made of brass or aluminum fine particles).

In addition, it is disclosed in JP-A-2010-18651 and JP-A-2013-91761 that an image having metallic gloss is formed by an ink containing a glitter pigment such as a metallic pigment, and this image is protected by a colorless transparent ink.

However, since a coated paper whose surface is coated with a white pigment, such as kaolin, calcium carbonate, or titanium dioxide, and a binder, such as latex or starch, has micron order irregularities on the surface thereof, the coated paper is affected by the unevenness of a medium even in the case of leafing a glitter pigment, and thus diffused reflection of light is likely to occur. Therefore, there is a problem in that it is difficult to obtain an image having good glitter. In addition, there is a problem in that, when the glitter image obtained by a colorless transparent ink is coated, the glitter of the image is further deteriorated by the influence of the slight light absorption characteristics of the colorless transparent ink and the surface unevenness of the image, and, if the application of the colorless transparent ink is insufficient, sufficient scratch resistance cannot be obtained.

Meanwhile, when a glitter image is formed by ejecting a glitter pigment ink onto a film such as a polyvinyl chloride film or a PET film, even if a resin is added to the glitter pigment ink, a good uniform film is not formed due to the difference in hardness or linear expansion coefficient of the glitter pigment ink, which is generally an inorganic material, and the resin, and, as a result, scratch resistance is likely to become insufficient.

As described above, in the related art, it is difficult for good glitter of the glitter image and scratch resistance of the glitter image to be compatible with each other.

SUMMARY

An advantage of some aspects of the invention is to provide a recording method, by which a glitter image excellent in both glitter and scratch resistance can be recorded, and a printer used in the recording method.

The invention can be realized in the following forms or application examples.

APPLICATION EXAMPLE 1

According to an aspect of the invention, there is provided a recording method, in which a glitter pigment ink and a clear ink containing substantially no color material is used with respect to a coated paper or a film, including: at least one of (A) primarily-applying the clear ink before applying the glitter pigment ink and (B) applying the clear ink in the same scanning at the time of applying the glitter pigment ink; and (C) secondarily-applying the clear ink after applying the glitter pigment ink.

According to the recording method of Application Example 1, by combining at least one of (A) primarily-applying of the clear ink and (B) applying of the clear ink with (C) secondarily-applying of the clear ink, it is possible to record a glitter image excellent in both glitter and scratch resistance.

APPLICATION EXAMPLE 2

In the recording method according to Application Example 1, when the landed weight of a glitter pigment contained in the glitter pigment ink per unit area is set to be 1, the landed weight of a resin contained in the clear ink per unit area satisfies the following conditions (1) and (2): (1) the sum of the landed weight of a resin in the clear ink per unit area in (A) primarily-applying of the clear ink and the landed weight of a resin in the clear ink per unit area in (B) applying of the clear ink is 0.4 to 2.7; and (2) the landed weight of a resin in the clear ink per unit area in (C) secondarily-applying of the clear ink is 2.0 to 10.5.

APPLICATION EXAMPLE 3

In the recording method according to Application Example 1 or 2, the volume occupied by a resin in the glitter pigment ink is 0.6 times to 5 times the volume occupied by a glitter pigment in the glitter pigment ink.

APPLICATION EXAMPLE 4

In the recording method according to any one of Application Examples 1 to 3, the particle diameter of a resin contained in the glitter pigment ink and/or the particle diameter of a resin contained in the clear ink is 5 times to 20 times the thickness of a glitter pigment contained in the glitter pigment ink.

APPLICATION EXAMPLE 5

In the recording method according to any one of Application Examples 1 to 4, the content of a glitter pigment in the glitter pigment ink is 0.5 mass % to 2 mass %.

APPLICATION EXAMPLE 6

In the recording method according to any one of Application Examples 1 to 5, the content of a resin in the clear ink may be 0.5 mass % to 8 mass %.

APPLICATION EXAMPLE 7

In the recording method according to any one of Application Examples 1 to 6, the glitter pigment contained in the glitter pigment ink may be flat.

APPLICATION EXAMPLE 8

According to another aspect of the invention, there is provided a printer, including a mode of adjusting the landed amount ratio of a glitter pigment ink and a clear ink depending on the kind of medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
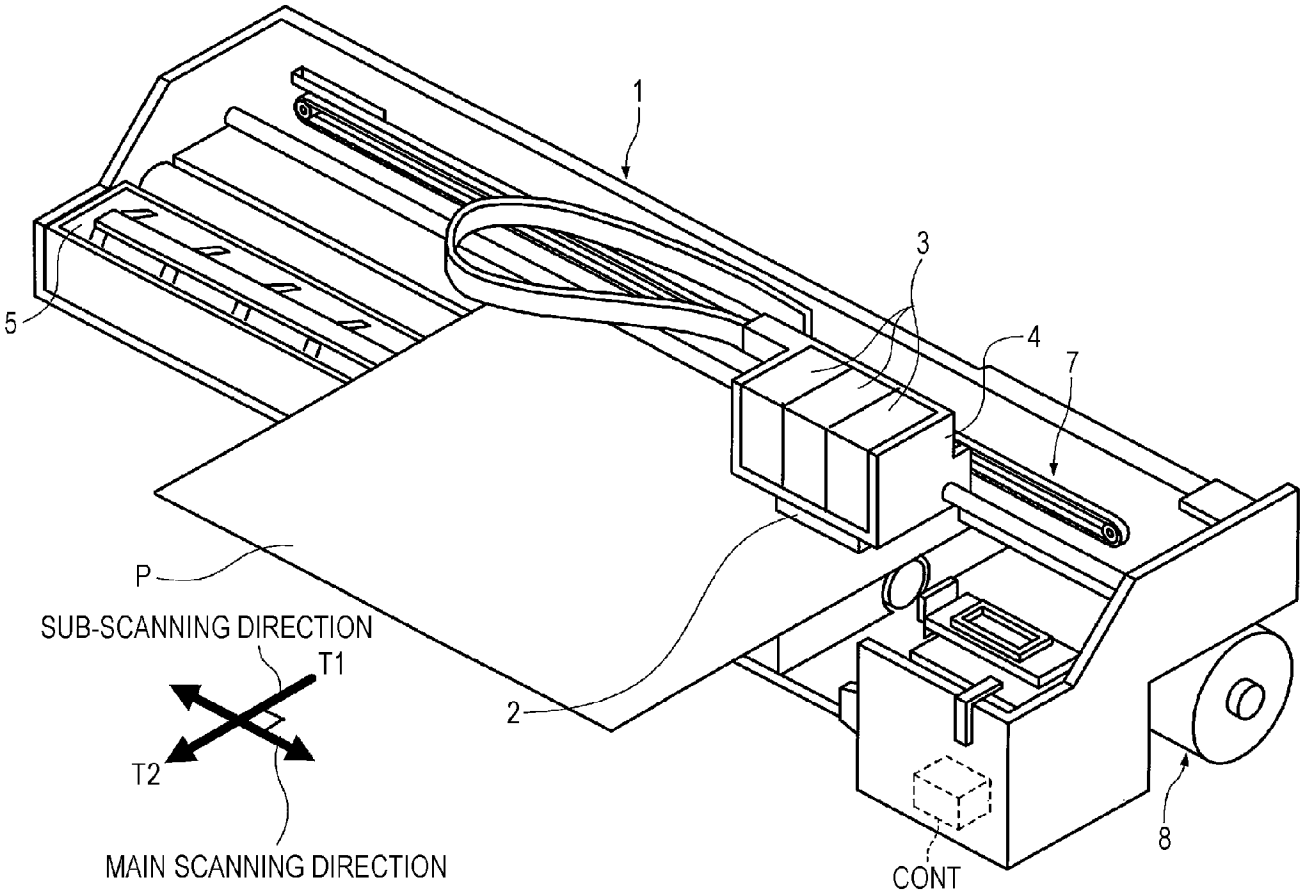
FIG. 1 is a perspective view showing the configuration of a printer used in a recording method according to the present embodiment.

Hereinafter, preferred embodiments of the invention will be described. Embodiments described below are intended to illustrate an example of the invention. The invention is not limited to the following embodiments, and includes various modifications to be carried out within the scope not changing the gist of the invention. In addition, all configurations described in the following embodiments should not necessarily be taken as essential requirements of the invention.

1. Recording Method

A recording method according to an embodiment of the invention, in which a glitter pigment ink and a clear ink containing substantially no color material is used with respect to a coated paper or a film, includes the steps of: at least one of (A) primarily-applying the clear ink before applying the glitter pigment ink and (B) applying the clear ink in the same scanning at the time of applying the glitter pigment ink; and (C) secondarily-applying the clear ink after applying the glitter pigment ink. Hereinafter, a clear ink, a glitter pigment ink, and an apparatus configuration will be described in this order for each step of the recording method.

1.1. Clear Ink

The clear ink used in the recording method according to the present embodiment is a transparent ink containing substantially no color material. In the invention, the phrase "containing substantially no A" means that A is not added to such a degree that the amount of A added exceeds the amount thereof to fully achieve the significance of adding A. A specific example of the phrase "containing substantially no A" includes the case in which A is not contained in an amount of 1.0 mass % or more, preferably 0.5 mass % or more, more preferably 0.1 mass % or more, still more preferably 0.05 mass % or more, particularly preferably 0.01 mass % or more, and more particularly preferably 0.001 mass % or more.

Since the clear ink used in the recording method according to the present embodiment is used for the following purposes, it is preferable that the clear ink contains a resin.

In step (A), the clear ink is used for the purpose of forming an undercoat layer. When the undercoat layer is formed, the adhesiveness to the recording medium is improved, and a smooth surface is easily obtained, and thus a glitter pigment applied on the undercoat layer tends to have smooth leafing. Further, since the undercoat layer functions as a receptive layer and has high affinity for a resin component in the glitter pigment ink, the glitter pigment and the resin component, which will be applied thereon, are uniformly spread, and, as a result, it is possible to realize the leafing of a flat glitter pigment. Therefore, an image having good glitter can be easily obtained. Accordingly, step (A) is particularly preferable in the case of recording a glitter image on a recording medium such as a coated paper having an uneven surface.

The coated paper used in the recording method according to the present embodiment is not particularly limited as long as it is a coated paper whose surface is coated with a white pigment, such as kaolin, calcium carbonate or titanium dioxide, and a binder, such as latex or starch.

In step (B), when the clear ink is recorded in the same scanning at the time of recording the glitter pigment ink, the adhesiveness to a recording medium is improved depending on the effect of a resin, and a layer in which the glitter pigment and the resin become dense is formed. Since the glitter pigment is leafed in the gap between the resin particles, an image having good glitter can be easily obtained. Accordingly, step (B) is preferable in the case of recording a glitter image on a recording medium such as a polyvinyl chloride film or a PET film having an originally even surface.

As the film used in the recording method according to the present embodiment, there is exemplified a molded product made of a plastic material such as polyvinyl chloride, polyethylene terephthalate, polycarbonate, polystyrene, polyurethane, polyethylene, polypropylene, or polyester.

In step (C), the clear ink is used for the purpose of forming an overcoat layer. When the overcoat layer is formed, a resin-made film is formed. Therefore, scratch resistance becomes good.

Examples of the resin contained in the clear ink include urethane resins, ester resins, fluorene-based resins, acrylic resins, polyolefin resins, rosin-modified resins, terpene resins, polyamide resins, epoxy resins, vinyl chloride resins, vinyl chloride-vinyl acetate copolymers, ethylene-vinyl acetate resins, and polyolefin wax. Among these, urethane resins, ester resins, fluorene-based resins, and acrylic resins are preferable. Further, in terms of glitter, it is desirable that the dispersed particle diameter of the resin emulsion used is small in terms of flatness of a film. Specifically, it is desirable that a resin having a dispersed particle diameter of 100 nm or less or a dissolution type of resin is used. These resins may be used alone or in a combination of two or more thereof. In the clear ink to be used in the above steps, the same resin may be used, and different resins may also be used with respect to each step.

In the case where different resins are used with respect to each step, for example, in the clear ink and glitter pigment ink to be used in step (B), it is preferable that a resin having a glass transition temperature (Tg) of lower than 25° C. is used. When the resin having a glass transition temperature (Tg) of lower than 25° C. is used, a film is rapidly formed, so that a glitter pigment is easily leafed, and an image having good glitter is easily obtained.

Meanwhile, in the case where different resins are used with respect to each step, for example, in the clear ink to be used in steps (A) and (C), it is preferable that a resin having a glass transition temperature (Tg) of 25° C. or higher is used. When the resin having a glass transition temperature (Tg) of 25° C. or higher is used, a film is rapidly formed, the adhesiveness between a recording medium and an image, and the scratch resistance of an image become good.

The content of a resin in the clear ink, in terms of solid content, is preferably 0.5 mass % to 8 mass %, and more preferably 1 mass % to 5 mass %, based on the total mass of the clear ink. When the content of the resin is within the above range, particularly, is not below the lower limit value, the resin is sufficiently formed into a film, and thus the scratch resistance of a glitter image becomes better. Further, when the content of the resin is within the above range, particularly, is not above the upper limit value, the film formed by the resin is easily flattened, and the glitter of an image becomes better. Hereinafter, each of the components contained in the clear ink will be described in detail.

1.1.1. Resin 1.1.1.1. Urethane Resin

A urethane resin is a polymer synthesized by reacting polyisocyanate with polyol. The synthesis of the urethane resin can be carried out by a known method.

Examples of polyisocyanates include: chained aliphatic isocyanates, such as tetramethylene diisocyanate, 1,6-hexamethylene diisocyanate, dodecamethylene diisocyanate, trimethyl hexamethylene diisocyanate, and lysine diisocyanate; aliphatic isocyanates having a cyclic structure, such as 1,3-cyclohexylene diisocyanate, 1,4-cyclohexylene diisocyanate, hydrogenated xylylene diisocyanate, isophorone diisocyanate, 4,4'-dicyclohexylmethane diisocyanate, and 3,3'-dimethyl-4,4'-dicyclohexyl diisocyanate; and aromatic isocyanates, such as 2,4-tolylene diisocyanate, 2,6-tolylene diisocyanate, m-phenylene diisocyanate, p-phenylene diisocyanate, 4,4'-diphenylmethane diisocyanate, 2,4'-diphenylmethane diisocyanate, 2,2'-diphenylmethane diisocyanate, 3,3'-dimethyl-4,4'-biphenylene diisocyanate, 3,3'-dimethoxy-4,4'-biphenylene diisocyanate, 3,3'-dichloro-4,4'-biphenylene diisocyanate, 1,5-naphthalene diisocyanate, 1,5-tetrahydronaphthalene diisocyanate, xylylene diisocyanate, and tetramethyl xylylene diisocyanate. At the time of synthesizing the urethane resin, the polyisocyanates may be used alone or in a combination of two or more thereof.

Examples of polyols may include polyether polyols and polycarbonate polyols.

Examples of polyether polyols include polyethylene glycol, polypropylene glycol, and poly tetramethylene glycol.

Examples of polycarbonate polyols include reaction products of diols, such as 1,3-propanediol, 1,4-butanediol, 1,6-hexanediol, diethylene glycol, polyethylene glycol, polypropylene glycol, and polytetramethylene glycol, and dialkyl carbonate such as phosgene, dimethyl carbonate, or cyclic carbonate such as ethylene carbonate.

At the time of synthesizing the urethane resin, the polyols may be used alone or in a combination of two or more thereof.

As the urethane resin, a polymer having a glass transition temperature (Tg) of −70° C. to 80° C. is preferably used, a polymer having a glass transition temperature (Tg) of −20° C. to 80° C. is more preferably used, and a polymer having a glass transition temperature (Tg) of 0° C. to 70° C. is particularly preferably used. When the glass transition temperature of the urethane resin is within the above range, particularly, is not below the lower limit, a clear image having low stickiness can be formed. Further, when the glass transition temperature of the urethane resin is within the above range, particularly, is not above the lower limit, a clear image is easily formed into a film, and thus it is more difficult to decrease the glitter of an image.

As the urethane resin, a solution-type urethane resin existing in a state of being dissolved in a solvent contained in the clear ink, or an emulsion-type urethane resin existing in a state of being dispersed in the clear ink in the form of particles can be used. Among these, it is preferable that the urethane resin is an emulsion-type urethane resin. Since the emulsion-type urethane resin exists in the form of particles, it hardly penetrates into a glitter image, compared to the solution-type urethane resin. Therefore, the glitter pigment in an image is less likely to disturb the alignment of the urethane resin, and thus an image having excellent glitter is easily obtained.

Emulsion-type resins are classified into self-emulsion type resins in each of which a resin is dispersed by introduction of a hydrophilic group into the resin, and force-emulsion type resins in each of which a resin is dispersed using an emulsifier such as a surfactant. Among these, as the emulsion type urethane resin, a self-emulsion type urethane resin in which a hydrophilic group is introduced into the urethane resin is preferable. The self-emulsion type urethane resin can have higher water resistance, compared to the force-emulsion type urethane resin.

Examples of the self-emulsion type urethane resin include a urethane resin having a structure of a salt of a carboxyl group (for example, a carboxylate salt), a urethane resin having a carboxyl group, a urethane resin having a carbonate skeleton, and a urethane resin having a sulfone group.

In addition, as the self-emulsion type urethane resin, a commercially available product can be used, and examples thereof include SF210 (trade name, manufactured by Dahchi Kogyo Senyaku Co., Ltd.) and WBR-2018 (trade name, manufactured by Taisei Fine Chemical Co., Ltd.)

When the urethane resin is used in an emulsion state, the average particle diameter of the urethane resin is preferably 10 nm to 135 nm, more preferably 10 nm to 110 nm, and particularly preferably 20 nm to 80 nm. When the average particle diameter of the urethane resin is within the above range, particularly, is not below the lower limit, the urethane resin is introduced into a glitter image or passes through the glitter image to reduce the contact of the urethane resin with a recording medium, and thus the glitter image can be better covered. Further, when the average particle diameter of the urethane resin is within the above range, particularly, is not above the lower limit, the film formed by the resin is flattened, and the generation of scattered light can be reduced, so that it is more difficult to decrease the glitter of an image.

The average particle diameter of the urethane resin can be measured by a particle size distribution measuring apparatus using a dynamic light scattering method as a measurement principle. As the particle size distribution measuring apparatus, there is exemplified "MICROTRACK UPA" (trade name, manufactured by Nikkisou Co., Ltd.) employing a heteodyning method as a frequency analysis method. In this specification, the "average particle diameter" refers to the average particle diameter based on volume, unless otherwise specified.

1.1.1.2. Ester Resin

An ester resin is a polymer obtained by polycondensing polyol and polycarboxylic acid. The ester resin can be synthesized by a known method.

Examples of the polyol include ethylene glycol, diethylene glycol, 1,3-propanediol, 1,4-butanediol, 1,4-cyclohexanedimethanol, trimethylol propane, and pentaerythritol. At the time of synthesizing the ester resin, these polyols may be used alone or in a combination of two or more thereof.

Examples of the polycarboxylic acid include oxalic acid, succinic acid, tartaric acid, malic acid, citric acid, phthalic acid, isophthalic acid, terephthalic acid, 2,6-naphthalene dicarboxylic acid, and adipic acid. At the time of synthesizing the ester resin, these polycarboxylic acids may be used alone or in a combination of two or more thereof.

The glass transition temperature (Tg) of the ester resin is preferably −70° C. to 80° C., more preferably −20° C. to 80° C., and particularly preferably 0° C. to 70° C. The reason that it is preferable that the glass transition temperature of the ester resin is within the above range is the same as that of the above-described urethane resin.

As the ester resin, a solution-type ester resin existing in a state of being dissolved in a solvent contained in the clear ink, or an emulsion-type ester resin existing in a state of being dispersed in the clear ink composition in the form of particles can be used. Among these, it is preferable that the ester resin is an emulsion-type ester resin. The reason that the emulsion-type ester resin is preferable is the same as that of the above-described urethane resin.

As the emulsion-type ester resin, any one of a force-emulsion type ester resin and a self-emulsion type ester resin can be used, but a self-emulsion type ester resin is preferable from the same reason as that of the-above described urethane resin.

As the self-emulsion type ester resin, a commercially available product can be used, and examples thereof include EASTEK 1100 and 1300 (trade names, manufactured by Eastman Chemical Japan Co., Ltd.) and ELITEL KZA-1449 AND KZA-3556 (trade names, manufactured by Unitika Ltd.).

When the ester resin is used in an emulsion state, the average particle diameter of the ester resin is preferably 10 nm to 135 nm, more preferably 10 nm to 110 nm, and particularly preferably 20 nm to 80 nm. The reason that it is preferable that the average particle diameter of the ester resin is within the above range is the same as that of the above-described urethane resin. Also, the average particle size of the ester resin can be measured in the same manner as the above-described urethane resin.

1.1.1.3. Fluorene-Based Resin

A fluorene-based resin can be obtained by reacting a polyol component including a first diol having a fluorene skeleton and a second diol having a hydrophilic group with a polyisocyanate component containing a polyisocyanate compound. The fluorene-based resin is preferable in that it can improve the light resistance and gas resistance of an image in addition to the function of improving the scratch resistance of the image while maintaining the glitter of the image.

Examples of the first diol having a fluorene skeleton include 9,9-bis(4-(hydroxymethyl)phenyl) fluorene, 9,9-bis (4-(2-hydroxyethoxyl)phenyl) fluorene, 9,9-bis(4-(3-hydroxypropoxyl)phenyl) fluorene, 9,9-bis(4-(4-hydroxybutoxyl)phenyl) fluorene, 9,9-bis(4-hydroxyphenyl) fluorene, 9,9-bis(4-hydroxy-tolyl) fluorene, and 9,9 bis(hydroxyalkyl) fluorene. Here, as the first diol, a commercially available product may be used, and examples thereof include bisphenoxyethanol fluorene, bisphenol fluorene, and biscresol fluorene (trade names, manufactured by Osaka Gas Chemicals Co., Ltd.).

These first diols having a fluorene skeleton may be used alone or in a combination of two or more thereof. Preferably, 9,9-bis(4-(2-hydroxyethoxyl)phenyl) fluorene is exemplified.

Further, the first diol having a fluorene skeleton can be combined at a rate of 40 mass % to 60 mass % with respect to the fluorene-based resin. When the content of the first diol having a fluorene skeleton is within the above range, scratch resistance and transparency become better.

The second diol can have a hydrophilic group. Examples of the hydrophilic group include: nonionic groups such as a polyoxyethylene group; and ionic groups such as a carboxyl group, a sulfonyl group, a phosphate group, and a sulfobetaine group.

Specific examples of the second diol having a carboxyl group include: dihydroxyl carboxylic acids such as 2,2-dimethylol acetic acid, 2,2-dimethylol lactate, 2,2-dimethylol propionic acid (2,2-bis(hydroxymethyl) propionic acid), 2,2-dimethylol butanoic acid, 2,2-dimethylol butyric acid, and 2,2-dimethylol valeric acid; and diaminocarboxylic acids such as lysine and arginine.

Specific examples of the second diol having a sulfonyl group include N,N-bis(2-hydroxyethyl)-2-aminoethane sulfonic acid, 1,3-phenylenediamine-4,6-disulfonic acid, diaminobutane sulfonic acid, 3,6-diamino-2-toluenesulfonic acid, and 2,4-diamino-5-toluene sulfonic acid.

A specific example of the second diol having a phosphate group includes 2,3-dihydroxypropyl phenyl phosphate.

Specific examples of the second diol having a betaine structure-containing group include sulfobetaine group-containing compounds, each of which is obtained by reacting a tertiary amine such as N-methyldiethanolamine with 1,3-propane sulfone.

In addition, as the second diol, there is exemplified an alkylene oxide-modified product in which alkylene oxide such as ethylene oxide or propylene oxide is added to the second diol.

These second diols may be used alone or in a combination of two or more thereof. Preferably, the second diol having a carboxyl group is exemplified, and an example thereof includes 2,2-dimethylol propionic acid.

The first diol having a hydrophilic group can be combined at a rate of 5 mass % to 15 mass % with respect to the fluorene-based resin. When the content of the first diol having a hydrophilic group is within the above range, scratch resistance and transparency become better.

The second diol can be combined such that the acid value of the fluorene-based resin is 10 KOHmg/g to 130 KOHmg/g, and preferably, 20 KOHmg/g to 60 KOHmg/g.

The fluorene-based resin, if necessary, may contain a polyol compound. The polyol compound is a compound having two or more hydroxyl groups, and examples thereof include low molecular weight polyols and high molecular weight polyols.

The polyisocyanate compound is a compound having two or more isocyanate groups, preferably, a compound having two isocyanate groups, and examples thereof include aliphatic polyisocyanates, alicyclic polyisocyanates, aromatic aliphatic polyisocyanates, and aromatic polyisocyanates.

Examples of the aliphatic polyisocyanate include hexamethylene diisocyanate and tetramethylene diisocyanate.

Examples of the alicyclic polyisocyanate include isophorone diisocyanate (3-isocyanatomethyl-3,5,5-trimethyl cyclohexyl isocyanate), 4,4'-, 2,4'- or 2,2'-dicyclohexylmethane diisocyanate, and a mixture thereof.

Examples of the aromatic aliphatic polyisocyanate include 1,3- or 1,4-xylene diisocyanate or a mixture thereof, and 1,3- or 1,4-bis(1-isocyanato-1-methylethyl)benzene or a mixture thereof.

Examples of the aromatic polyisocyanate include 2,4'- or 2,2'-diphenylmethane diisocyanate or mixtures thereof, 2,4- or 2,6-tolylene diisocyanate or a mixture thereof, 4,4'-toluidine diisocyanate, and 1,5-naphthalene diisocyanate.

Further, as the polyisocyanate compound, there are exemplified: multimers (for example, dimers, trimmers, and the like) of the above various polyisocyanate compounds; biuret-modified products obtained by reaction of the above various polyisocyanate compounds or multimers thereof with water; allophanate-modified products obtained by reaction of the above various polyisocyanate compounds with alcohols or the above low molecular weight polyols; oxadiazinetrione-modified products obtained by reaction of the above various polyisocyanate compounds with carbon dioxide; and polyol-modified products obtained by reaction of the above various polyisocyanate compounds with the above low molecular weight polyols.

These polyisocyanate compounds may be used alone or in a combination of two or more thereof. Preferably, the alicyclic polyisocyanate is exemplified, and an example thereof includes isophorone diisocyanate.

Meanwhile, in order to react polyol components (that is, a first diol having a fluorene skeleton, a second diol having a hydrophilic group, and, if necessary, a polyol compound) with polyisocyante components (that is, polyisocyanate compounds), a known method may be used. For example, these components can be combined such that the equivalent ratio (NCO/hydroxyl group) of an isocyanate group of the polyisocyanate component to a hydroxyl group of the polyol component is 0.4 to 1.0, and preferably, 0.8 to 0.95. Therefore, these components can be combined at a rate of 30 mass % to 45 mass % with respect to the fluorene-based resin. When the content of the first diol having a fluorene skeleton is within the above range, fixability and transparency are excellent.

The fluorene-based resin can be used in the form of any one of a water-insoluble resin (emulsion) and a water-soluble resin, but it is preferable that the fluorene-based resin is used in the form of a water-soluble resin. The weight average molecular weight of the fluorene-based resin is preferably 3,000 to 20,000, more preferably 5,000 to 15,000 and particularly preferably 6,000 to 12,000. The glass transition temperature (Tg) of the fluorene-based resin is preferably 0° C. or higher, more preferably 0° C. to 250° C., more preferably 40° C. to 250° C., still more preferably 80° C. to 250° C., and particularly preferably 120° C. to 250° C.

1.1.1.4. Acrylic Resin

Examples of acrylic resin include: homopolymers of acrylic acid, acrylic acid esters, methacrylic acid or methacrylic acid esters; and copolymers of the monomers thereof and acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, or vinylidene chloride. Here, the copolymer can be used in the form of any one of a random copolymer, a block copolymer, an alternating copolymer, and a graft copolymer.

Examples of the acrylic resin include: 3MF series manufactured by Taisei Fine Chemical Co., Ltd., such as 3MF-309S, 3MF-320, 3MF-333, 3MF-407, 3MF-574, and 3MF-587; acrylic emulsion Boncoat 40-418EF manufactured by DIC Co., Ltd.; ES-960MC manufactured by Takamatsu Oil & Fat Co, Ltd.; and EPG1200 manufactured by Mitsui Chemicals, Inc.

1.1.2. Polyolefin Wax

Polyolefin wax may be added to the clear ink. One of the functions of the polyolefin wax is to enhance the sliding properties of the formed film. Thus, the scratch resistance of an overcoat layer can be further improved.

The polyolefin wax is not particularly limited, but examples thereof include: waxes prepared from olefin, such as ethylene, propylene or butylene, or a derivative thereof; and copolymers thereof. Specific examples of the polyolefin wax include polyethylene wax, polypropylene wax, polybutylene wax, and paraffin wax. These polyolefin waxes can be used alone or in a combination of two or more thereof.

As the polyolefin wax, a commercially available product can be used. Examples of the commercially available product include: CHEMIPAR series, such as CHEMIPAR W4005 (polyethylene-based), manufactured by Mitsui Chemicals Inc.; AQUACER series, such as AQUACER 513, 515, 531, 552, and 840 (all polyethylene-based), 498, 537, and 539 (all paraffin-based), manufactured by BYK Japan Co., Ltd.; HITECH series, such as HITECH E-7025P, HITECH E-2213, HITECH E-9460, HITECH E-9015, HITECH E-4A, HITECH E-5403P, HITECH E-8237 (all, manufactured by Toho Chemical Industry Co., Ltd.); and NOPCOAT PEM-17 (manufactured by SAN NOPCO LTD., polyethylene emulsion, particle size 40 nm). These commercially available products are commercially supplied in the form of an aqueous emulsion in which polyolefin wax is dispersed in water by a general method. In the clear ink used in the recording method according to the present embodiment, the polyolefin wax can be directly added in the form of an aqueous emulsion.

In the case where the clear ink contains the polyolefin wax, the content of the polyolefin wax, in terms of solid content, is preferably 0.05 mass % to 2 mass %, and more preferably 0.1 mass % to 1 mass %, based on the total mass of the clear ink. When the content of the polyolefin wax is within the above range, there is a case of further improving scratch resistance while maintaining the glitter of an image.

1.1.3. Water-Soluble Organic Solvent

A water-soluble organic solvent may be added to the clear ink. Examples of the water-soluble organic solvent include polyhydric alcohols and pyrrolidone derivatives.

Examples of polyhydric alcohols include ethylene glycol, diethylene glycol, triethylene glycol, polyethylene glycol, polypropylene glycol, dipropylene glycol, propylene glycol, butylene glycol, 1,2-butanediol, 1,2-pentanediol, 1,5-pentanediol, 1,2 hexanediol, 2-ethyl-1,3-hexanediol, 1,6-hexanediol, 1,2-heptanediol, 1,2-octanediol, 1,2,6-hexanetriol, thioglycol, hexylene glycol, glycerin, trimethylol ethane, and trimethylol propane. These polyhydric alcohols are effective in reducing the clogging of nozzle holes when ejecting the clear ink from the nozzle holes of an ink jet recording apparatus.

Examples of pyrrolidone derivatives include N-methyl-2-pyrrolidone, N-ethyl-2-pyrrolidone, N-vinyl-2-pyrrolidone, 2-pyrrolidone, and 5-methyl-2-pyrrolidone.

These water-soluble organic solvents may be used alone or in a combination of two or more thereof.

When the clear ink contains the water-soluble organic solvent, the content of the water-soluble organic solvent is preferably 1 mass % to 50 mass %, and more preferably 5 mass % to 45 mass %, based on the total mass of the clear ink.

1.1.4. Surfactant

A surfactant may be added to the clear ink. The surfactant can be used to suitably control the surface tension of the clear ink or the interfacial tension between the clear ink and the printer member, such as a nozzle, in contact with the clear ink. Therefore, when this surfactant is used in an ink jet recording apparatus, it is possible to improve ejection stability. In addition, there is an effect of uniformly wet-spreading the clear ink on a recording medium.

Such a surfactant is not particularly limited, but nonionic surfactants are preferable. Among the nonionic surfactants, silicone-based surfactants and acetylene glycol-based surfactants are more preferable.

As the silicone-based surfactant, polysiloxane compounds are preferably used, and polyether-modified organosiloxane is exemplified. Specific examples of the silicone-based surfactant: BYK-306, BYK-307, BYK-333, BYK-341, BYK-345, BYK-346, and BYK-348 (trade names, manufactured by BYK Japan KK); and KF-351A, KF-352A, KF-353, KF-354L, KF-355A, KF-615A, KF-945, KF-640, KF-642, KF-643, KF-6020, X-22-4515, KF-6011, KF-6012, KF-6015, KF-6017 (trade names, manufactured by Shin-Etsu chemical Co., Ltd.).

Examples of the acetylene glycol-based surfactant include: SURFYNOL 104, 104E, 104H, 104A, 104BC, 104DPM, 104PA, 104PG-50, 104S, 420, 440, 465, 485, SE, SE-F, 504,61, DF37, CT111, CT121, CT131, CT136, TG, GA, and DF110D (all trade names, manufactured by Air Products and Chemicals Inc.); OLFINE B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (all trade names, manufactured by Nissin Chemical Industry Co., Ltd.); and ACETYLENOL E00, E00P, E40, E100 (all trade names, manufactured by Kawaken Fine Chemical Co., Ltd.).

Here, as the surfactants other than the above-mentioned surfactants, anionic surfactants, cationic surfactants, amphoteric surfactants, and the like may be added.

When the clear ink contains the surfactant, the content of the surfactant is preferably 0.05 mass % to 2 mass %, and more preferably 0.1 mass % to 1 mass %, based on the total mass of the clear ink.

1.1.5. pH Adjuster

Examples of the pH adjuster include Potassium dihydrogen phosphate, disodium hydrogen phosphate, sodium hydroxide, lithium hydroxide, potassium hydroxide, ammonia, diethanolamine, triethanolamine, tripropanolamine, triisopropanolamine, potassium carbonate, sodium carbonate, and sodium hydrogen carbonate.

1.1.6. Water

As the main solvent of the clear ink, water is preferable. As the water, pure water or ultrapure water, such as ion exchange water, ultrafiltration water, reverse osmosis water, or distilled water is preferably used. Particularly, when such water is sterilized by UV irradiation or the addition of hydrogen peroxide, the generation of mold and bacteria can be prevented over a long period of time, which is preferable.

1.1.7. Other Components

If necessary, an antiseptic agent, an antifungal agent, an antirust agent, a chelating agent or an ultraviolet absorber, or the like may be added to the clear ink.

1.2. Glitter Pigment Ink 1.2.1. Glitter Pigment

The glitter pigment ink used in the recording method according to the invention contains a glitter pigment. The glitter pigment is not particularly limited as long as it can exhibit glossiness when it is adhered to a recording medium, but examples thereof include: one or more alloys (hereinafter, referred to as "metal pigment") selected from the group consisting of aluminum, silver, gold, platinum, nickel, chromium, tin, zinc, indium, titanium, and copper; and pearl pigment having a pearl gloss. Representative examples of the pearl pigment include pigments having a pearlescent gloss and an interferential gloss, such as titanium dioxide-coated mica, argentine, and bismuth chloride. Further, the glitter pigment may be subjected to surface treatment in order to suppress the reaction with water. When the ink contains the glitter pigment, it is possible to form an image having excellent glitter.

The shape of the glitter pigment may be any shape of a spherical shape, a spindle shape, a needle shape, and the like, but a flat shape is preferable. When the shape of base metal pigment is a flat shape, light reflectivity becomes good, and thus an image having excellent glitter can be recorded.

In the invention, the "flat shape" refers to a shape in which the area observed from a predetermined angle (when viewed from the top) is larger than that observed from an angle perpendicular to the viewing direction. Particularly, the ratio ($S_1/S_0$) of the area $S_1$ [$\mu m^2$] observed from a direction in which a projected area is maximized (when viewed from the top) to the area $S_0$ [$\mu m^2$] observed from a direction in which the area observed in a direction perpendicular to the viewing direction is maximized is preferably 2 or more, more preferably 5 or more, and particularly preferably 8 or more. As this value, for example, observations are performed for any 10 particles, and the average value of the values calculated for these particles can be adopted.

In the case where the shape of the glitter pigment is a flat shape, the average particle diameter of the glitter pigment is preferably 0.25 μm to 3 μm, more preferably 0.25 μm to 1.5 μm, and particularly preferably equal to or more than 0.25 μm and less than 1.0 μm. Further, the average thickness of the glitter pigment is preferably 1 nm to 100 nm, and more preferably 5 nm to 50 nm. When the average particle diameter and average thickness of the glitter pigment are within the above ranges, leafing easily occurs, and thus an image having excellent glitter can be recorded.

Here, the average particle diameter refers to a volume average particle diameter calculated from volume-based particle size distribution, this particle size distribution being obtained by detecting a light intensity distribution pattern of diffraction scattering light using a laser diffraction type particle size distribution measuring apparatus and then calculating the light intensity distribution pattern based on a light scattering theory. As the laser diffraction type particle size distribution measuring apparatus, there are exemplified NANOTRACK UPA and MICROTRACK UPA (both, manufactured by Nikkisou Co., Ltd.).

Further, the average thickness refers to an average value of 10 thicknesses of base metal pigments, the thicknesses thereof being obtained by photographing side images of base metal pigments using a transmission electron microscope (TEM) or a scanning electron microscope (SEM). As the transmission electron microscope (TEM), the model "JEM-2000EX", manufactured by JEOL Ltd., is exemplified, and, as the scanning electron microscope (SEM), the model "S-4700", manufactured by Hitachi High-Technologies Corporation, is exemplified.

The content of the glitter pigment is preferably 0.5 mass % to 2 mass %, and more preferably 0.8 mass % to 1.5 mass %, based on the total mass of the glitter pigment ink. When the content of the glitter pigment is within the above range, it is possible to improve the ejection stability from nozzles of an ink jet recording apparatus and the storage stability of the glitter pigment ink.

In the glitter pigment ink used in the recording method according to the present embodiment, it is preferable that among the above-described glitter pigments, a metal pigment is used. The reason for using the metal pigment is that the metal pigment can impart excellent glitter to an image to be recorded.

1.2.2. Other Components 1.2.2.1. Resin

In the glitter pigment ink used in the recording method according to the present embodiment, a resin may be added. When a resin is added to the glitter pigment ink, due to the effect of the resin, the adhesiveness of the glitter pigment ink to a recording medium is improved, and a layer in which glitter pigment and resin are densely contained is formed. Since the glitter pigment is leafed in the gap between the resin particles, an image having good glitter can be easily obtained.

As the kind of the resin, the resins exemplified in the above-described clear ink are exemplified. Here, the volume of the resin in the glitter pigment ink is preferably 0.6 times to 5 times, and more preferably 0.7 times to 4 times the volume of the glitter pigment in the glitter pigment ink. By having such a volume relationship, both good glitter and good scratch resistance of an image are compatible. Here, when the volume of the resin in the glitter pigment ink is 5 or more times the volume of the glitter pigment in the glitter pigment ink, the distance between the glitter pigments tends to be increased, and thus there is a case that the glitter of an image deteriorate.

Further, the particle diameter of the resin contained in the glitter pigment ink and/or the particle diameter of the resin contained in the clear ink is preferably 5 to 20 times the thickness of the glitter pigment in the glitter pigment ink. By having such a size relationship, the dispersibility of the glitter pigment in the glitter pigment ink becomes good, and thus an image having good glitter can be obtained. Further, according to such a size relationship, it is considered that the action of resin particles inhibiting the glitter received from the glitter pigment is reduced. Moreover, it is considered that the effect of imparting scratch resistance according to the resin is further improved.

1.2.2.2. Other Components

In the glitter pigment ink used in the recording method according to the present embodiment, if necessary, a water-soluble organic solvent, a surfactant, a pH adjusting agent, water, an antiseptic agent, an antifungal agent, an antirust agent, a chelating agent, an ultraviolet absorber, or the like, which have be described in the case of the clear ink, may be added.

Here, the glitter pigment ink may be a water-based ink which contains water as a main solvent (for example, a solvent whose content is 50 mass % or more based on the total mass of the glitter pigment ink composition), and may also be an ink which contains an organic solvent (for example, alcohols, ketones, carboxylic acid esters, and ethers) as a main solvent.

1.3. Apparatus Configuration

Next, an ink jet recording apparatus which can be used in the recording method according to the present embodiment (hereinafter, briefly referred to as an "ink jet recording apparatus") will be described with reference to FIGS. 1 and 2. In the respective drawings used in the following description, in order for the size of each member to be recognizable, the scale of each member may be appropriately changed. In the present embodiment, as the ink jet recording apparatus, an ink jet printer (hereinafter, briefly referred to as a "printer") is illustrated. The invention is not limited to this apparatus configuration.

FIG. 1 is a perspective view showing the configuration of a printer 1 which can be used in the recording method according to the present embodiment. As shown in FIG. 1, the printer 1 is a serial printer. The serial printer refers to a printer in which a head is mounted on a carriage moving in a predetermined direction, and thus the head moves along with the movement of the carriage, thereby ejecting droplets onto a recording medium.

As shown in FIG. 1, the printer 1 includes a carriage 4 mounted with a head 2 and detachably mounted with an ink cartridge 3, a platen 5 which is disposed under the head 2 and along which a recording medium P is conveyed, a carriage moving mechanism 7 moving the carriage 4 in a medium width direction of the recording medium P, and a medium feed mechanism 8 conveying the recording medium P in a medium feed direction. Further, the printer 1 has a control unit CONT controlling the overall operation of the printer 1. Here, the medium width direction refers to a main scanning direction (head scanning direction). The medium feed direction refers to a sub-scanning direction (a direction perpendicular to the main scanning direction).

The control unit CONT can perform execution actions for controlling the executing timing of each of the actions of the above-described carriage 4, head 2, carriage moving mechanism 7, and medium feed mechanism 8 and cooperating therewith. In such a control unit CONT, it is possible to mount a mode of adjusting the landed weight ratio of the glitter pigment ink and the clear ink depending on the kind of the recording medium. As described above, in the coated paper and the film, generally, the uneven states of surfaces thereof are different from each other, and the ink absorption rates thereof are also different from each other. For example, in the film having low ink absorbency, it is considered that the necessary landed weight of the clear ink is increased. In contrast, in the case of the coated paper, it is considered that unevenness is formed on the surface of the coated paper, and thus anchor effects are imparted, and that, when ink permeates into the coated paper, glitter pigments are uniformly arranged on the surface thereof, and thus the necessary landed weight of the clear ink in the coated paper may be less than that of the clear ink in the film. As such, since the control unit CONT has the mode of adjusting the landed weight ratio of the glitter pigment ink and the clear ink, there is a case where the glitter and scratch resistance of an image and the adhesiveness to the recording medium become good, and thus it is desirable to mount the mode.

Figure 2:
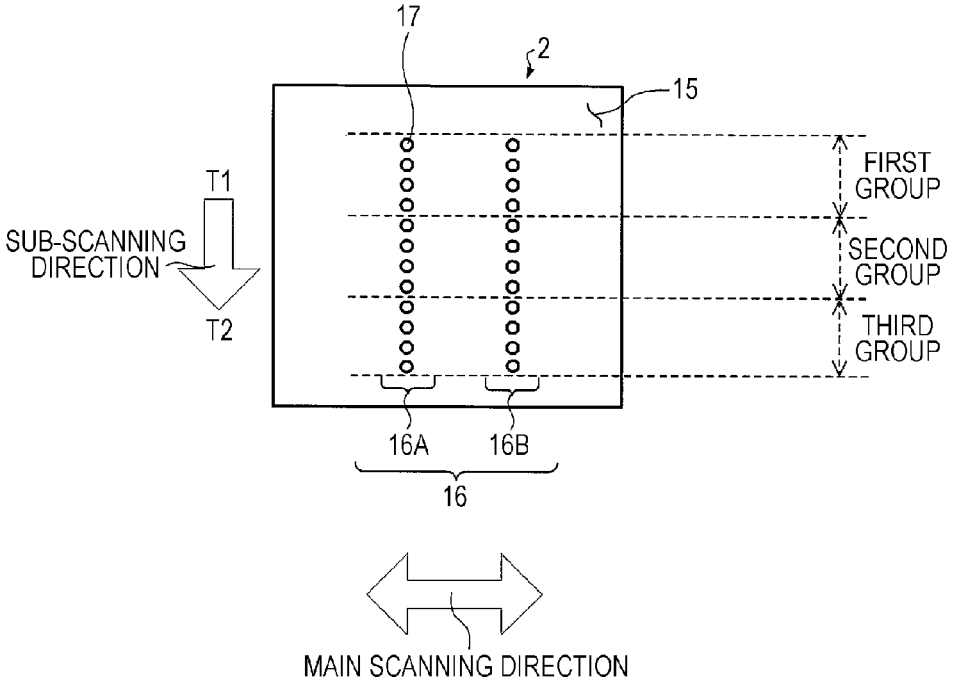
FIG. 2 is a schematic view showing the nozzle face of a printer used in a recording method according to the present embodiment.

FIG. 2 is a schematic view showing the nozzle face 15 of the head 2 of the printer 1. As shown in FIG. 2, the head 2 is provided with the nozzle face 15. In the nozzle face 15 which is an ejection face of ink, a plurality of nozzle rows 16 are arranged. The plurality of nozzle rows 16 are provided with a plurality of nozzle openings 17 for ejecting ink with respect to each nozzle row.

In the head 2, the ink is formed into droplets having a microparticle diameter, and the droplets are ejected from the nozzle openings 17 to be adhered onto the recording medium P. The head 2 is not particularly limited as long as it has the above function, and any ink jet recording method may be used in the head 2. Examples of the ink jet recording method of the head 2 include: a method (electrostatic suction method) in which a strong electric field is applied between nozzles and accelerating electrodes disposed in front of the nozzles to continuously eject ink droplets from the nozzles, thereby providing print information signals to polarization electrodes while the ink droplets flying between the deflecting electrodes, or a method (electrostatic suction method) in which ink droplets are ejected in response to the print information signals without deflecting the ink droplets; a method in which ink droplets are forcibly ejected by applying pressure to liquid ink using a small pump and mechanically vibrating nozzles using a quartz oscillator; a method (piezo method) in which ink droplets are ejected and recorded by simultaneously applying pressure and print information signals to ink using a piezoelectric device; and a method (thermal jet method) in which ink droplets are ejected and recorded by heating and foaming ink using microelectrodes according to print information signals.

The plurality of nozzle rows 16 are configured, for example, such that ink having different compositions can be ejected with respect to each nozzle row. In the example of FIG. 2, the nozzle rows are provided in two rows depending on the composition of the ink, and are respectively arranged along the main scanning direction. Specifically, the plurality of nozzle rows 16 include the nozzle row 16A capable of ejecting the clear ink and the nozzle row 16B capable of ejecting the glitter pigment ink. In the example of FIG. 2, a case of two nozzle rows is illustrated. However, the invention is not limited thereto, and a case of three or more nozzle rows may be illustrated.

In the example of FIG. 2, the nozzle rows 16A and 16B respectively extend on the nozzle face 15 in the sub-scanning direction crossing the main scanning direction. However, the invention is not limited thereto, and the nozzle rows 16A and 16B may be disposed such that an angle is given in the nozzle face 15 in a direction crossing the main scanning direction.

The plurality of nozzle openings 17 are arranged in a predetermined pattern to form a nozzle row. In the present embodiment, the plurality of the nozzle openings 17 are arranged in rows in the sub-scanning direction in the nozzle face 15, but the invention is not limited thereto. For example, the nozzle openings 17 may be arranged in a zigzag manner along the direction perpendicular to the main scanning direction in the nozzle face 15. Here, the number of the nozzle openings 17 constituting the nozzle row is not particularly limited.

The plurality of nozzle rows 16 can be divided into a plurality of regions including a predetermined number of nozzle openings 17 toward the sub-scanning direction, and used. In the example of FIG. 2, the nozzle rows 16A and 16B include a first group located on upstream side T1 of the sub-scanning direction, a second group located on downstream side T2 of the sub-scanning direction compared to the first group, and a third group located on further downstream side T2 compared to the second group. Here, the number of the nozzle openings 17 constituting the one group is not particularly limited. Further, the number of the nozzle openings 17 constituting the group may be the same with respect to each group, and may also be different with respect to each group. Moreover, the nozzle rows may be divided into four or more groups, and used.

As described above, the serial head type printer (recording apparatus) has mainly been described, but the invention is not limited to this embodiment. Specifically, a line head type printer in which recording heads are fixed and sequentially arranged in the sub-scanning direction or a lateral type printer which includes a head (carriage) provided with a descending mechanism moving in the X direction and the Y direction (main scanning direction and sub-scanning direction) as described in JP-A-2002-225255 may also be used. For example, SUREPRESS L-4033A (manufactured by Seiko Epson Corporation) is a lateral type printer.

Among these, it is preferable that a recording apparatus recording an image using the divided nozzle row of a serial head or a lateral type recording apparatus is used. By using these recording apparatuses, when an ink set of clear ink and glitter pigment ink is used, a step (step (A)) of forming an undercoat layer using clear ink, a step (step (B)) of applying the glitter pigment ink and the clear ink in the same scanning manner, and a step (step (C)) of forming an overcoat layer using the clear ink are easily performed by one recording apparatus.

1.4. Each Step of Recording Method

The recording method according to the present embodiment, as described above, includes the steps of: at least one of (A) primarily-applying the clear ink before applying the glitter pigment ink and (B) applying the clear ink in the same scanning at the time of applying the glitter pigment ink; and (C) secondarily-applying the clear ink after applying the glitter pigment ink. Hereinafter, each of the steps will be described in detail. The "image" in the invention represents a printing pattern formed from dot (droplet) groups, and includes text printing and solid printing.

1.4.1. Step (A)

Step (A) is a step of primarily-applying the clear ink before applying the glitter pigment ink.

In the case of using the printer 1 of FIG. 1, step (A) is performed as follows. First, droplets of the clear ink are ejected from the nozzle openings 17 of the nozzle row 16A while moving the carriage 4 in the main scanning direction, thus adhering the droplets of the clear ink onto a recording medium. Thus, a transparent undercoat layer made of the clear ink is formed on the recording medium.

The undercoat layer may be formed to cover the entire surface of the recording medium, and may also be formed to cover a part of the recording medium. However, when step (A) is carried out, it is necessary that the undercoat layer is formed in the region for ejecting droplets of the glitter pigment ink in the subsequent steps.

When step (A) is carried out, subsequently, step (B) may be carried out, and a step of ejecting only the droplets of the glitter pigment ink onto the recording medium may also be carried out.

When this undercoat layer is formed, adhesiveness to the recording medium is improved, and a smooth surface is obtained, and thus the glitter pigment applied thereon is easily leafed. Further, since the undercoat layer has a function as a receiving layer and has high affinity for components in the glitter pigment ink, when these components permeate into the undercoat layer, the glitter pigment applied thereon is easily leafed. Thus, an image having good glitter can be easily obtained. Accordingly, step (A) is particularly suitable when recording a glitter image onto a recording medium, such as a coated paper, having an uneven surface.

1.4.2. Step (B)

Step (B) is a step of applying the clear ink in the same scanning at the time of applying the glitter pigment ink.

In the case of using the printer 1 of FIG. 1, step (B) is performed as follows. First, droplets of the clear ink are ejected from the nozzle openings 17 of the nozzle row 16A, and droplets of the glitter pigment ink are ejected from the nozzle openings 17 of the nozzle row 16B while moving the carriage 4 in the main scanning direction, thus adhering the droplets thereof onto a recording medium or the undercoat layer. Thus, adhesiveness to the recording medium is improved, and a mixed layer in which glitter pigment and resin become dense is formed. Since the glitter pigment is leafed in the gap between the resin particles, an image having good glitter can be easily obtained. Accordingly, step (B) is suitable when recording a glitter image onto a recording medium, such as a polyvinyl chloride film or a PET film, having an originally smooth surface.

Further, the clear ink used in step (B) may have the same composition as that of the clear ink used in step (A), and may also have a different composition from that of the clear ink used in step (A). When the compositions are different from each other, the glass transition temperature (Tg) of the resin contained in the clear ink used in step (A) is preferably 25° C. or higher. In contrast, the glass transition temperature (Tg) of the resin contained in the clear ink used in step (B) is preferably lower than 25° C. In the case of using the printer 1 of FIG. 1, the clear ink ejected from the nozzle row 16A and the clear ink ejected from the nozzle row 16B can be used in the step (B) in which these compositions are separately used.

When step (A) is carried out, step (B) is carried out after step (A). When step (A) is not carried out, a mixed layer is directly formed on the recording medium by carrying out step (B).

Here, the "glitter" in the invention refers to the property characterized, for example, by the specular glossiness of the obtained image (refer to Japanese Industrial Standard (JIS) Z8741). For example, as the kind of glitter, there are glitter in which light is specular-reflected, and so-called matte tone glitter. They can be respectively characterized, for example, by degree of specular glossiness.

As described above, the recording method according to the present embodiment includes at least one of step (A) and step (B), and thus it is possible to record a glitter image having excellent adhesiveness to the surface of the recording medium.

1.4.3. Step (C)

Step (C) is a step of secondarily-applying the clear ink after applying the glitter pigment ink, and is an essential step in the recording method according to the present embodiment.

In the case of using the printer 1 of FIG. 1, step (C) is performed as follows. As described above, after recording the glitter image using the glitter pigment ink, droplets of the clear ink are ejected onto the glitter image from the nozzle openings 17 of the nozzle row 16A while moving the carriage 4 in the main scanning direction, so as to form an overcoat layer covering the surface of the glitter image. In other words, the overcoat layer and the glitter image are in contact with each other.

Further, it is desired that the overcoat layer covers the entire glitter image, but the overcoat layer may cover a part of the glitter image. Further, the overcoat layer may be configured to form one continuous film on the glitter image, and may also be configured to form two or more separate films. Further, the overcoat layer may be formed in the region on the recording medium in which the glitter image is not formed as long as it cover at least a part of the surface of the glitter image.

In step (C) in the recording method according to the present embodiment, it is preferable that the clear ink is ejected at the timing at which the clear ink is not mixed with droplets of the glitter pigment ink on the recording medium. In other words, after the surface of the glitter image is sufficiently dried, droplets of the clear ink may be adhered onto the surface of the glitter image. By doing so, the disturbance of arrangement of glitter pigment particles in the glitter image can be reduced, and thus a glitter image having more excellent glitter can be obtained.

The thickness of the overcoat layer formed on the glitter image is preferably 0.1 μm to 0.2 μm. When the thickness of the overcoat layer is within the above range, the scratch resistance of the glitter image tends to be better while maintaining the glitter of the glitter image.

1.4.4. Characteristics of Recording Method

In the recording method according to the present embodiment, the amount of glitter pigment contained in the glitter image is preferably 10 μg/inch$^2$ to 100 μg/inch$^2$. When the amount of glitter pigment contained in the glitter image is within the above range, particularly, is not below the lower limit, the glitter of the glitter image becomes excellent. Further, the amount of glitter pigment contained in the glitter image is above the upper limit, glitter is not improved any more to become an equilibrium state, and thus the improvement of glitter is hardly desired even though the glitter pigment is more contained. Therefore, when the amount of glitter pigment contained in the glitter image is preferably 100 μg/inch$^2$ or less, the amount of glitter pigment ink that is used can be reduced.

The amount (μg/inch$^2$) of glitter pigment contained in the glitter image refers to the amount of glitter pigment contained per unit area of the glitter image. For example, the amount (μg/inch$^2$) of glitter pigment contained in the glitter image is obtained by dividing the content (μg) of glitter pigment in the total ejection amount of the glitter pigment ink used for forming the glitter image by the area (inch$^2$) of the glitter image.

In the recording method according to the present embodiment, when the landed weight of clear ink in each step satisfies step (C)>step (A)>step (B), it is possible to achieve a good balance between glitter and scratch resistance of an image. When the landed weight of clear ink is set to be step (A)>step (B), the flatness of the undercoat layer becomes good, and the leafing of glitter pigment becomes easy. As a result, the glitter of an image becomes good. When the landed weight of clear ink is set to be step (C)>step (A), the scratch resistance of a glitter image becomes good, and good glitter can be easily obtained without dulling the glitter image. Further, in the recording method according to the present embodiment, when the landed weight of clear ink in each step satisfies step (C)>step (A)+step (B), the balance between glitter and scratch resistance of an image become better.

Further, in the recording method according to the present embodiment, when the following conditions (1) and (2) are satisfied, the balance between glitter and scratch resistance of an image become better.

That is, when the landed weight of the glitter pigment contained in the glitter pigment ink per unit area is set to be 1, the landed weight of the resin contained in the clear ink per unit area satisfies the following conditions (1) and (2): (1) the sum of the landed weight of the resin in the clear ink per unit area in step (A) and the landed weight of the resin in the clear ink per unit area in step (B) is 0.4 to 2.7; and (2) the landed weight of the resin in the clear ink per unit area in step (C) is 2.0 to 10.5.

1.4.5. Separate Use of Nozzles

In the recording method according to the present embodiment, it is preferable that nozzle rows are used after dividing these nozzle rows into each group including a predetermined number of nozzle openings. Hereinafter, a recording method in which nozzle rows are divided and then used will be described with reference to FIG. 2.

As shown in FIG. 2, the nozzle rows 16A and 16B are divided into three groups such as a first group located on upstream side T1 of the sub-scanning direction, a second group located on downstream side T2 of the sub-scanning direction compared to the first group, and a third group located on downstream side T3 of the sub-scanning direction compared to the second group, and then used. Here, when only one kind of the above-described clear ink is used, the nozzles rows can be divided into two, and then used.

First, droplets of the clear ink are ejected from the first group of the first nozzle row 16A while moving the carriage 4 in the main scanning direction, so as to adhere the droplets of the clear ink onto a recording medium P (step (A)). Thus, an undercoat layer made of the clear ink is formed on the recording medium P.

Next, the recording medium P is moved in a downstream side (T2) direction of the sub-scanning direction by the length of the first group in the sub-scanning direction. Then, while moving the carriage 4 in the main scanning direction, droplets of the glitter pigment ink are ejected from the second group of the second nozzle row 16B, or droplets of the clear ink are ejected from the second group of the first nozzle row 16A and droplets of the glitter pigment ink are ejected from the second group of the second nozzle row 16B (step (B)), so as to adhere the droplets of the glitter pigment ink onto the undercoat layer formed on the recording medium P. Thus, a first glitter image is obtained.

Next, the recording medium P is moved in a downstream side (T2) direction of the sub-scanning direction by the length of the second group in the sub-scanning direction. Further, while moving the carriage 4 in the main scanning direction, droplets of the clear ink are ejected from the third group of the first nozzle row 16A, so as to adhere the droplets of the clear ink onto the first glitter image. Thus, a second glitter image provided with the overcoat layer is formed on the first glitter image.

Meanwhile, at the time of forming the first glitter image by ejecting the droplets of the glitter pigment ink from the second group of the second nozzle row 16B (at the time of the same scanning of the carriage 4), droplets of the clear ink are ejected again from the first group of the first nozzle row 16A, and thus it is possible to form a undercoat layer at the portion (upstream side of the first glitter image in the sub-scanning direction), at which an undercoat layer is not formed, on the recording medium. Further, at the time of covering the first glitter image with an overcoat layer (at the time of the same scanning of the carriage 4), droplets of the glitter pigment ink are ejected again from the second group of the second nozzle row 16B, and thus it is possible to adhere the droplets of the glitter pigment ink onto the recording medium P. Thus, a second glitter image is formed at the portion (upstream side of the first glitter image in the sub-scanning direction), at which the first glitter image is not recorded. Thereafter (in other words, after forming the overcoat layer of the first glitter image), the recording medium P is moved in a downstream side (T2) direction of the sub-scanning direction by the length of the third group in the sub-scanning direction, and droplets of the clear ink are ejected from the third group of the first nozzle row 16A, so as to adhere the droplets of the clear ink onto the second glitter image, thereby obtaining a third glitter image provided with an overcoat layer is formed on the second glitter image (on the second resin film).

It is possible to form a glitter image on the recording medium by repeating such operations. In the recording method according to the present embodiment, in the case of step (B) and step (C), the overcoat layer and the mixed layer may be formed, and thus the nozzle rows can be divided into two.

In the recording method according to the present embodiment, it is possible to increase the speed of recording by dividing the nozzle rows and then using the divided nozzle rows. Further, when the nozzle rows are divided and used, the back feed of the recording medium may not be performed, or the number of back feeds of the recording medium can be reduced. Thus, it is possible to reduce the deviation of printing position easily caused by the back feed of the recording medium.

2. Examples

Hereinafter, the invention will be described in detail with reference to Examples and Comparative Examples, but the invention is not limited to these Examples.

2.1. Preparation of Glitter Pigment Ink 2.1.1. Preparation of Aluminum Particle Dispersion First, a polyethylene terephthalate (PET) film having a smooth surface (surface roughness Ra: 0.02 μm or less) was provided.

Next, silicone oil was applied onto the entire surface of one side of this PET film. A film made of aluminum (hereinafter, briefly referred to as "aluminum film") was formed on the silicone oil-applied surface of the PET film using a deposition method.

Next, the film provided with the aluminum film was immersed into diethylene glycol diethyl ether, and irradiated with ultrasonic waves, so as to separate and pulverize the aluminum film from the film. Next, the resulting product was put into a homogenizer, and pulverized for about 8 hours, so as to obtain a dispersion of flat aluminum particles. The concentration of aluminum particles in the dispersion was 10 mass %.

Next, 100 parts by mass of diethylene glycol diethyl ether was added to 100 parts by mass of the obtained dispersion containing aluminum particles to adjust the concentration of aluminum particles to 5 mass %, and then 20 parts by mass of 2-(perfluorohexyl)ethyl phosphonic acid was added to 100 parts by mass of aluminum particles, and the surface treatment of aluminum particles was performed at 55° C. with ultrasonic irradiation for 3 hours. Thereafter, the surface-treated aluminum particles were centrifugally precipitated by a centrifugal separator (10000 rpm×30 min) and the supernatant portion thereof was discarded. Then, 1.5 mass % of a fluorine-based surfactant (product name: "Megafac F-553", manufactured by DIC Corporation), 28.5 mass % of water, 65 mass % of propylene glycol were added thereto, and the aluminum particles surface-treated with ultrasonic irradiation were redispersed, so as to obtain a dispersion containing 5 mass % of aluminum particles. The average particle diameter of the aluminum particles in the dispersion was 0.8 μm, and the average thickness thereof was 10 nm.

Next, the obtained dispersion containing the aluminum particles was heated to 70° C., and this temperature was maintained for 6 days, so as to sufficiently treat the surface of the aluminum particles.

Finally, a mixture of hexylene glycol and water was added to this dispersion containing the aluminum particles, and ultrasonic stirring was performed, so as to obtain an aluminum particle dispersion having the following composition.

| Composition of aluminum particle dispersion | |
|---|---|
| aluminum particle (solid content) | 1.20 mass % |
| propylene glycol | 15.60 mass % |
| hexylene glycol | 50.00 mass % |
| water | 32.84 mass % |
| MEGAFAC 553 | 0.36 mass % |

2.1.2. Preparation of Ink

The above-obtained aluminum particle dispersion was centrifugally separated to ultrasonically precipitate aluminum particles, and the supernatant portion thereof was discarded. Then, 28 mass % of propylene glycol, 12 mass % of hexylene glycol, 0.4 mass % of a silicone surfactant (product name: "BYK-348", manufactured by BYK Japan KK), resin, and a balance of water were respectively added thereto, and then aluminum particles were redispersed with ultrasonic irradiation. Then, triethanolamine was added thereto to adjust pH to 8.5, so as to obtain photoluminesecent pigment inks Ma to Mc having the composition given in Table 1.

TABLE 1

| | | Kind of glitter pigment ink | | |
|---|---|---|---|---|
| | | Ma | Mb | Mc |
| Component | Aluminum particles (solid content) | 1.20 | 1.20 | 1.60 |
| | Urethane resin (solid content) | 0.50 | 2.00 | 0.50 |
| | Hexylene glycol | 12.00 | 12.00 | 12.00 |
| | Propylene glycol | 28.00 | 28.00 | 28.00 |
| | BYK-348 | 0.40 | 0.40 | 0.40 |
| | Triethanol amine | 0.15 | 0.15 | 0.15 |
| | Water | 57.90 | 56.40 | 57.50 |
| Physical properties | pH | 8.5 | 8.5 | 8.2 |
| | Resin volume/pigment volume | 0.9 | 3.8 | 0.7 |

The components given in Table 1 are as follows. Here, the contents of aluminum pigment and resin given in Table 1 are values converted into a solid content.

Urethane resin (trade name "W-1005E", manufactured by Ube Industries, Ltd., average particle diameter: 69 nm, Tg: −44° C.)

BYK348 (trade name, manufactured by BYK Japan KK., polysiloxane-based surfactant)

2.2. Preparation of Clear Ink

The components given in Table 2 was mixed and stirred, and then filtered by a membrane filter with a pore size of 5 μm to remove impurities such as dust and coarse particles, thereby preparing clear inks Ca to Cc.

TABLE 2

| | | Kind of clear ink | | |
|---|---|---|---|---|
| | | Ca | Cb | Cc |
| Component | Fluorene-based resin | 3.0 | 5.0 | — |
| | Acrylic resin (solid content) | — | — | 2.0 |
| | 1,2-hexanediol | 5.0 | 5.0 | 5.0 |
| | Propylene glycol | 12.0 | 12.0 | 12.0 |
| | 2-pyrrolidone | 4.0 | 4.0 | 4.0 |
| | Tripropanolamine | 0.5 | 0.5 | 0.5 |
| | Parafin wax (solid content) | 1.0 | 1.0 | 1.0 |
| | BYK-348 | 0.5 | 0.5 | 0.5 |
| | Water | 76.0 | 74.0 | 77.0 |

The components given in Table 2 are as follows. Here, the contents of resin and wax given in Table 2 are values converted into a solid content.

Fluorene-based resin (obtained by the following manufacturing method, water-soluble resin, weight average molecular weight: 3300)

Acrylic resin (trade name "EPG1200", manufactured by Mitsui Chemicals Inc., average particle diameter: 41 nm, Tg: 75° C. or higher)

Paraffin wax (trade name "AQUACER513", manufactured by BYK Japan KK, average particle diameter: 150 nm)

Here, as the fluorene-based resin, a fluorene-based resin synthesized in the following manner was used. The fluorene-based resin was synthesized by sufficiently mixing 30 parts by mass of isophorone diisocyanate, 50 parts by mass of 4,4'-(9-fluorenylidene)bis[2-(phenoxy)ethanol], 100 parts by mass of 3-hydroxy-2(hydroxymethyl)-2-methyl propionic acid, and 30 parts by mass of triethylamine and then stirring the mixture at 120° C. for 5 hours in the presence of a catalyst. The obtained fluorene-based resin was a resin containing 4,4'-(9-fluorenylidene)bis[2-(phenoxy)ethanol] at a monomer composition ratio of about 50 mass % and having a molecular weight of 3300.

2.3. Evaluation Method and Result

In evaluation 1, a cartridge filled with the above-mentioned glitter ink and resin ink was set as an ink set, and the ink jet printer PX-G930 (trade name, manufactured by Seiko Epson Corporation) mounted with this cartridge was used.

2.3.1. Fabrication of Evaluation Samples

Evaluation samples of Examples 1 to 9 and Comparative Examples 1 and 2 were fabricated as follows. First, an ink cartridge provided for the exclusive use of the ink jet printer PX-G930 (manufactured by Seiko Epson Corporation, Nozzle resolution: 180 dpi) was respectively filled with the above obtained glitter pigment ink and clear ink given in Table 3 one by one, and this ink cartridge was mounted in the above printer.

Next, droplets of glitter pigment ink and clear ink were ejected from nozzle openings of the printer under the conditions given in Table 3, so as to fabricate evaluation samples each having a glitter image on a recording medium. Here, the recording of the glitter image and resin film was performed in an image resolution of 1440 dpi×1440 dpi.

As the recording medium, the following three types of recording media were used.

PGPP (trade name, manufactured by Seiko Epson Corporation, EPSON photo paper)

NP Coat (trade name, manufactured by Lintec Corporation, art paper)

PET50A (trade name, manufactured by Lintec Corporation, polyester, transparent)

2.3.2. Evaluation Test (1) Glossiness (Glitter)

Each of the above-obtained evaluation samples was observed visually, and the metallic feeling (that is, glitter) thereof was evaluated. The evaluation results thereof are summarized in Table 3. Evaluation criteria are as follows.

A: metallic feeling having specular gloss (image clarity).

B: specular gloss does not exist, but metallic feeling exists.

C: metallic feeling does not exist, and looks gray.

(2) Scratch Resistance

The scratch resistance evaluation of each of the above-obtained evaluation samples was performed using a Japan Society for the Promotion of Science friction fastness tester (trade name "AB-301", manufactured by Tester industry Co., Ltd.) in accordance with JIS K5701 (ISO 11628). That is, the recording surface of each of the evaluation samples was mounted with a gold cloth and rubbed over a load, and then the peeling state of the recording surface of each of the evaluation samples was visually observed. The evaluation results thereof are summarized in Table 3. Here, Evaluation criteria are changed as follows with respect to each recording medium.

Recording Medium: PGPP

A: Scratch is not observed even when evaluation sample is rubbed by 50 times of reciprocation with a load of 200 g.

B: Scratch is not observed even when evaluation sample is rubbed by 25 times of reciprocation with a load of 200 g.

C: Scratch is observed when evaluation sample is rubbed by several times of reciprocation with a load of 200 g.

Recording Medium: NP Coat, PET50A

A: Scratch is not observed even when evaluation sample is rubbed by 100 times of reciprocation with a load of 500 g.

B: Scratch is not observed even when evaluation sample is rubbed by 50 times of reciprocation with a load of 500 g.

C: Scratch is observed when evaluation sample is rubbed by several times of reciprocation with a load of 500 g.

2.3.3. Evaluation Result

The results of evaluation tests are shown in Table 3.

TABLE 3

| | | Ex. 1 | Ex. 2 | Ex. 3 | Ex. 4 | Ex. 5 | Ex. 6 | Ex. 7 | Ex. 8 | Ex. 9 | Comp. Ex. 1 | Comp. Ex. 2 |
|---|---|---|---|---|---|---|---|---|---|---|---|---|
| Kind of glitter pigment ink | | Ma | Ma | Ma | Ma | Ma | Ma | Ma | Mb | Mc | Ma | Ma |
| Landed weight of phtoluminescent pigment (μg/inch$^2$) | | 46 | 46 | 46 | 46 | 46 | 46 | 46 | 46 | 62 | 46 | 46 |
| Kind of clear ink | | Ca | Ca | Ca | Ca | Ca | Cb | Cb | Ca | Cc | Ca | Cb |
| Step (A) | Landed weight of resin (μg/inch$^2$) | 39 | 20 | 39 | 116 | 0 | 64 | 97 | 39 | 26 | 194 | 0 |
| Step (B) | Landed weight of resin (μg/inch$^2$) | 0 | 0 | 58 | 0 | 116 | 0 | 0 | 0 | 0 | 0 | 0 |
| Step (C) | Landed weight of resin (μg/inch$^2$) | 232 | 232 | 155 | 232 | 232 | 387 | 451 | 232 | 155 | 0 | 580 |
| Resin (step (A) + step (B)):glitter pigment | | 0.84:1 | 0.42:1 | 2.09:1 | 2.51:1 | 2.51:1 | 1.39:1 | 2.01:1 | 0.84:1 | 0.41:1 | 4.19:1 | 0:1 |
| Resin (step (C)):glitter pigment | | 5.02:1 | 5.02:1 | 3.35:1 | 5.02:1 | 5.02:1 | 8.38:1 | 9.77:1 | 5.02:1 | 2.50:1 | 0 | 12.57:1 |
| Evaluation result (PGPP) | Glossiness (glitter) | A | A | A | A | A | A | B | B | B | A | B |
| | Scratch resistance | A | A | A | A | A | A | A | A | A | C | A |
| Evaluation result (NPcoat) | Glossiness (glitter) | B | B | B | A | B | B | B | B | B | A | B |
| | Scratch resistance | A | B | A | A | A | A | A | A | A | C | C |
| Evaluation result (PET50A) | Glossiness (glitter) | A | A | B | B | B | B | B | B | B | A | B |
| | Scratch resistance | A | B | A | A | A | A | A | A | A | C | C |

Each of the evaluation samples according to Examples 1 to 9 had a glitter image excellent in both glitter and scratch resistance. In contrast, in each of the evaluation samples according to Comparative Examples 1 and 2, any one of glitter and scratch resistance of an image was not excellent, and could not be compatible.

The invention can be variously modified without being limited to the above-mentioned embodiments. For example, the invention includes substantially the same configurations as those described in the embodiments (for example, configurations having the same function, method and result or configurations having the same object and effect). The invention includes configurations that replace non-essential parts of the configurations described in the embodiments. The invention includes configurations that can achieve the same action and effect as those described in the embodiments or the same purpose as the configurations described in the embodiments. The invention includes configurations obtained by applying known technologies to the configurations described in the embodiments.

The entire disclosure of Japanese Patent Application No. 2014-125108, filed Jun. 18, 2014 is expressly incorporated by reference herein.

What is claimed is:

1. A recording method, in which a glitter pigment ink and a clear ink containing substantially no color material is used with respect to a coated paper or a film, comprising:

applying the clear ink in the same scanning at the time of applying the glitter pigment ink; and secondarily-applying the clear ink after applying the glitter pigment ink, wherein the clear ink and the glitter pigment ink are applied to the recording medium using a recording head having a first nozzle row for ejecting the clear ink and a second nozzle row for electing the glitter pigment ink during the same scanning, the first nozzle row and the second nozzle row are arranged along a first direction, and the first nozzle row and the second nozzle row respectively extend in a second direction that crosses the first direction.

2. The recording method according to claim 1, wherein, when the landed weight of a glitter pigment contained in the glitter pigment ink per unit area is set to be 1, the landed weight of a resin contained in the clear ink per unit area satisfies the following conditions (1) and (2):

(1) the sum of the landed weight of a resin in the clear ink per unit area in (A) primarily-applying of the clear ink and the landed weight of a resin in the clear ink per unit area in (B) applying of the clear ink is 0.4 to 2.7; and (2) the landed weight of a resin in the clear ink per unit area in (C) secondarily-applying of the clear ink is 2.0 to 10.5.

3. The recording method according to claim 1, wherein the volume occupied by a resin in the glitter pigment ink is 0.6 times to 5times the volume occupied by a glitter pigment in the glitter pigment ink.

4. The recording method according to claim 1, wherein the particle diameter of a resin contained in the glitter pigment ink and/or the particle diameter of a resin contained in the clear ink is 5 times to 20 times the thickness of a glitter pigment contained in the glitter pigment ink.

5. The recording method according to claim 1, wherein the content of a glitter pigment in the glitter pigment ink is 0.5 mass % to 2 mass %.

6. The recording method according to claim 1, wherein the content of a resin in the clear ink is 0.5 mass % to 8 mass %.

7. The recording method according to claim 1, wherein the glitter pigment contained in the glitter pigment ink is flat.

8. The recording method according to claim 1, wherein the first nozzle row and the second nozzle row are used after dividing each of the nozzle rows into two or three nozzle groups.

* * * * *